US008186797B2

(12) United States Patent
Okura et al.

(10) Patent No.: US 8,186,797 B2
(45) Date of Patent: May 29, 2012

(54) INKJET PRINTER HAVING TEMPERATURE RAISING PREVENTING DEVICE

(75) Inventors: Yuma Okura, Tomi (JP); Tetsuharu Ikeda, Tomi (JP); Takahiro Hasegawa, Tomi (JP); Masakazu Nakazawa, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 13/193,729

(22) Filed: Jul. 29, 2011

(65) Prior Publication Data

US 2011/0285799 A1 Nov. 24, 2011

Related U.S. Application Data

(63) Continuation of application No. PCT/JP2010/000505, filed on Jan. 28, 2010.

(30) Foreign Application Priority Data

Jan. 30, 2009 (JP) ..... 2009-020550

(51) Int. Cl.
*B41J 29/377* (2006.01)

(52) U.S. Cl. ..... 347/18; 347/102

(58) Field of Classification Search ..... 347/102, 347/18

See application file for complete search history.

(56) References Cited

U.S. PATENT DOCUMENTS

| | | | | |
|---|---|---|---|---|
| 4,971,408 | A * | 11/1990 | Hoisington et al. | 347/102 |
| 5,281,442 | A * | 1/1994 | Fulton et al. | 427/374.5 |
| 6,439,712 | B1 * | 8/2002 | Mizutani et al. | 347/102 |
| 7,104,709 | B1 * | 9/2006 | Maher et al. | 400/76 |
| 7,538,299 | B2 * | 5/2009 | Spence et al. | 219/388 |
| 2005/0151815 | A1 * | 7/2005 | Kanai et al. | 347/102 |
| 2010/0053291 | A1 * | 3/2010 | Yoda | 347/102 |
| 2010/0188469 | A1 * | 7/2010 | Ikegami | 347/102 |

FOREIGN PATENT DOCUMENTS

| | | |
|---|---|---|
| JP | 2-187340 | 7/1990 |
| JP | 2004-338119 | 12/2004 |

OTHER PUBLICATIONS

International Search Report for International Application No. PCT/JP2010/000505, Mar. 9, 2010.

* cited by examiner

*Primary Examiner* — Julian Huffman
*Assistant Examiner* — Sharon A Polk
(74) *Attorney, Agent, or Firm* — Ditthavong Mori & Steiner, P.C.

(57) ABSTRACT

An inkjet printer includes a platen having a placing face, a printing device, and a printing medium feeding device. A guide is provided on a feeding-out side via which a printing medium is to be fed out from the platen. The guide has a guide face. A printing medium temperature raising device is to heat the guide face so as to raise a temperature of the printing medium placed on the guide face. A temperature raising preventing device is provided between the guide face of the guide and a portion of the placing face facing a printing target region. The temperature raising preventing device is configured to prevent an extended portion of the printing medium from being heated by the printing medium temperature raising device. The extended portion corresponds an area which is extended to the feeding-out side by a predetermined length from the printing target region.

19 Claims, 7 Drawing Sheets

INKJET PRINTER HAVING TEMPERATURE RAISING PREVENTING DEVICE

CROSS-REFERENCE TO RELATED APPLICATIONS

The present application is a continuation application of International Application No. PCT/JP2010/000505, filed Jan. 28, 2010, which claims priority to Japanese Patent Application No. 2009-020550, filed Jan. 30, 2009. The contents of these applications are incorporated herein by reference in their entirety.

BACKGROUND OF THE INVENTION

1. Field of the Invention

The present invention relates to an inkjet printer.

2. Discussion of the Background

As an example of a printer apparatus which performs printing on a printing medium, an inkjet printer has been known which is structured so that a sheet-shaped printing medium is supported on a platen, a printer head oppositely disposed to the printing medium is provided above a face of the platen, and printing is performed by ejecting ink from the printer head to the printing medium. When printing is to be performed by the inkjet printer which is structured as described above, the printer head is, for example, reciprocated in a right and left direction and, while feeding a printing medium in a direction perpendicular to the movement of the printer head (in a feeding direction), ink is ejected from a nozzle opening formed at an under face of the printer head to make the ink adhered to a face oppositely disposed to the under face of the printer head in a desired pattern (see, for example, Japanese Patent Laid-Open No. 2004-338119).

In the inkjet printer as described above, liquid ink fine particles are ejected and adhered to a printing medium to perform highly precise printing and thus the ink ejected to the printing medium is required to be fixed and dried as quick as possible and further, it is required to attain high productivity. Therefore, temperature control of the printing medium to which the ink has been ejected from the printer head is important.

Accordingly, the inkjet printer as described above is provided with a heater which heats the platen for raising temperature of a printing medium. The temperature of the printing medium can be raised up to a predetermined temperature by heating the platen to a predetermined set temperature depending on the printing medium and a type of inks which are used.

SUMMARY OF THE INVENTION

According to one aspect of the present invention, an inkjet printer includes a platen, a printing device, a printing medium feeding device, a guide, a printing medium temperature raising device, and a temperature raising preventing device. The platen has a placing face on which a printing medium is to be placed. The printing device includes a printer head that is provided facing the placing face to eject ink to a printing target region of the printing medium. The printer head is configured to eject ink while the printer head relatively moves with respect to the printing medium. The printing medium feeding device is configured to feed the printing medium. The guide is provided on a feeding-out side via which the printing medium is to be fed out from the platen. The guide has a guide face to hold the printing medium which have been fed out from the placing face of the platen. The printing medium temperature raising device is to heat the guide face so as to raise a temperature of the printing medium placed on the guide face. The temperature raising preventing device is provided between the guide face of the guide and a portion of the placing face facing the printing target region. The temperature raising preventing device is configured to prevent an extended portion of the printing medium from being heated by the printing medium temperature raising device. The extended portion corresponds an area which is extended to the feeding-out side by a predetermined length from the printing target region.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6A is a view showing a main platen and a front platen which are physically separated from each other; FIG. 6B is a view showing a state in which a heat insulation member is disposed between a main platen and a front platen; FIG. 6C is a view showing a state in which a cooling pipe is disposed between a main platen and a front platen; and FIG. 6D is a view showing a state in which a heat radiation means and a cooling fan are disposed between a main platen and a front platen.

DESCRIPTION OF THE EMBODIMENTS

Figure 1:
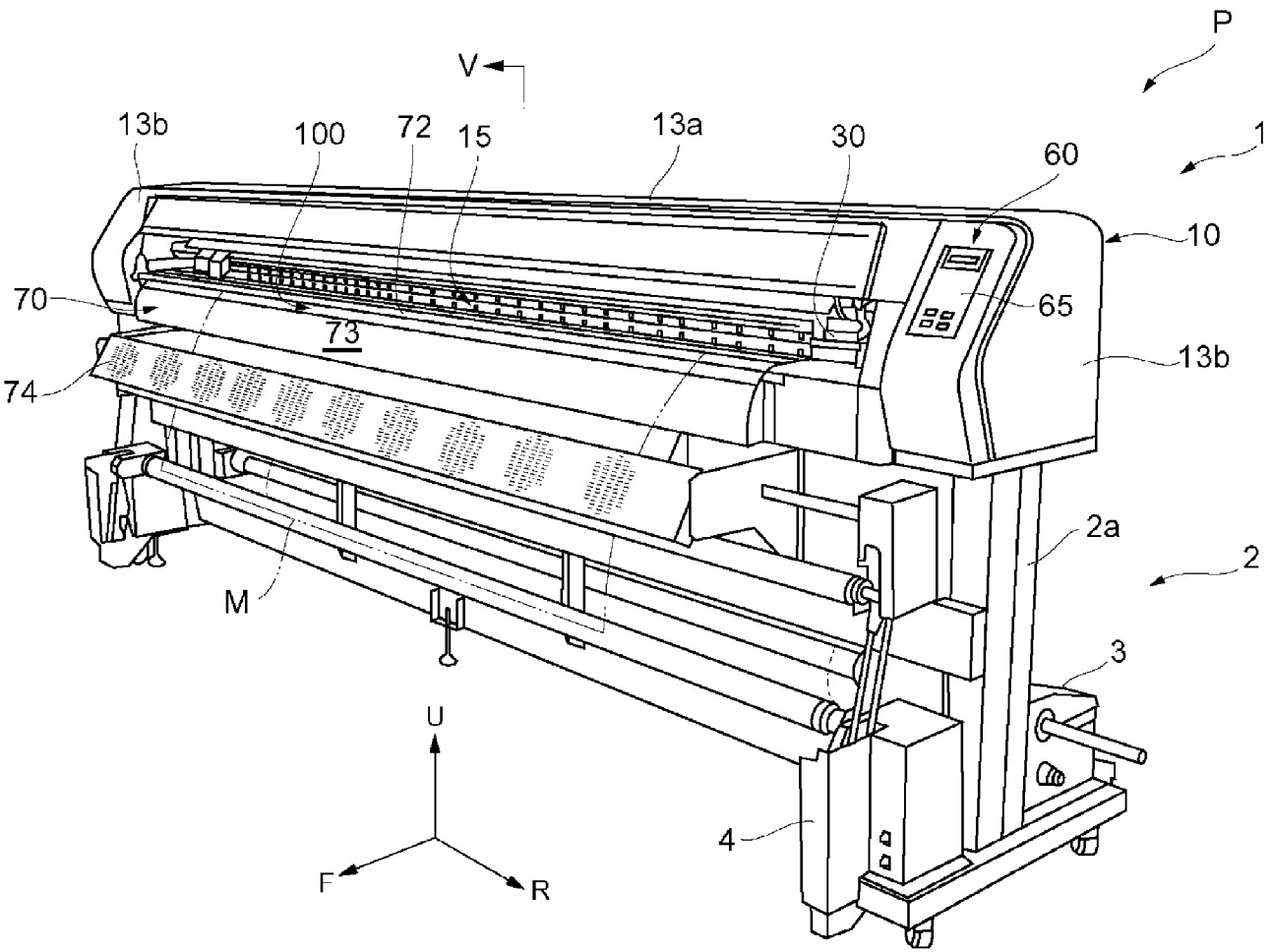
FIG. 1 is an outward appearance perspective view showing a printer apparatus in accordance with an embodiment of the present invention which is viewed from an obliquely front side.
Figure 2:
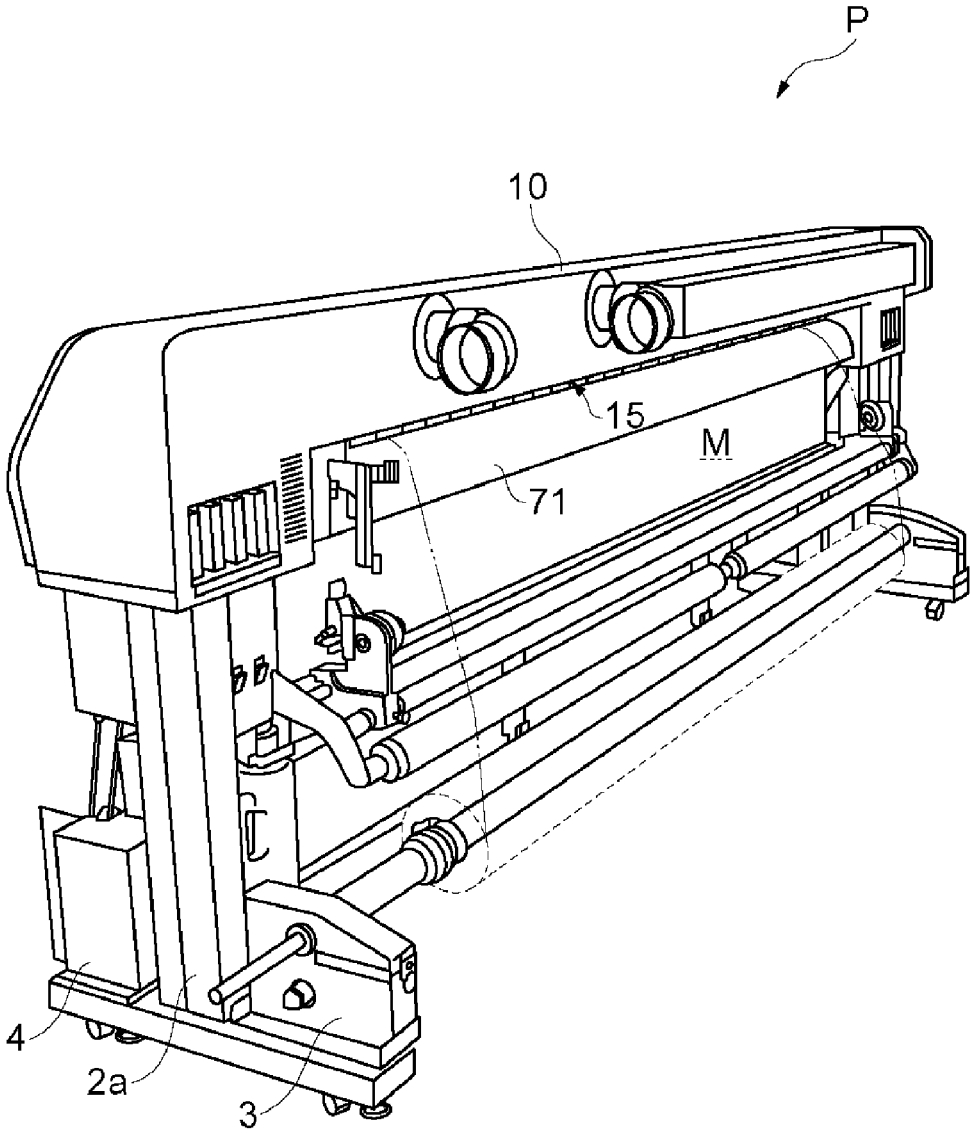
FIG. 2 is an outward appearance perspective view showing the printer apparatus which is viewed from an obliquely rear side.
Figure 3:
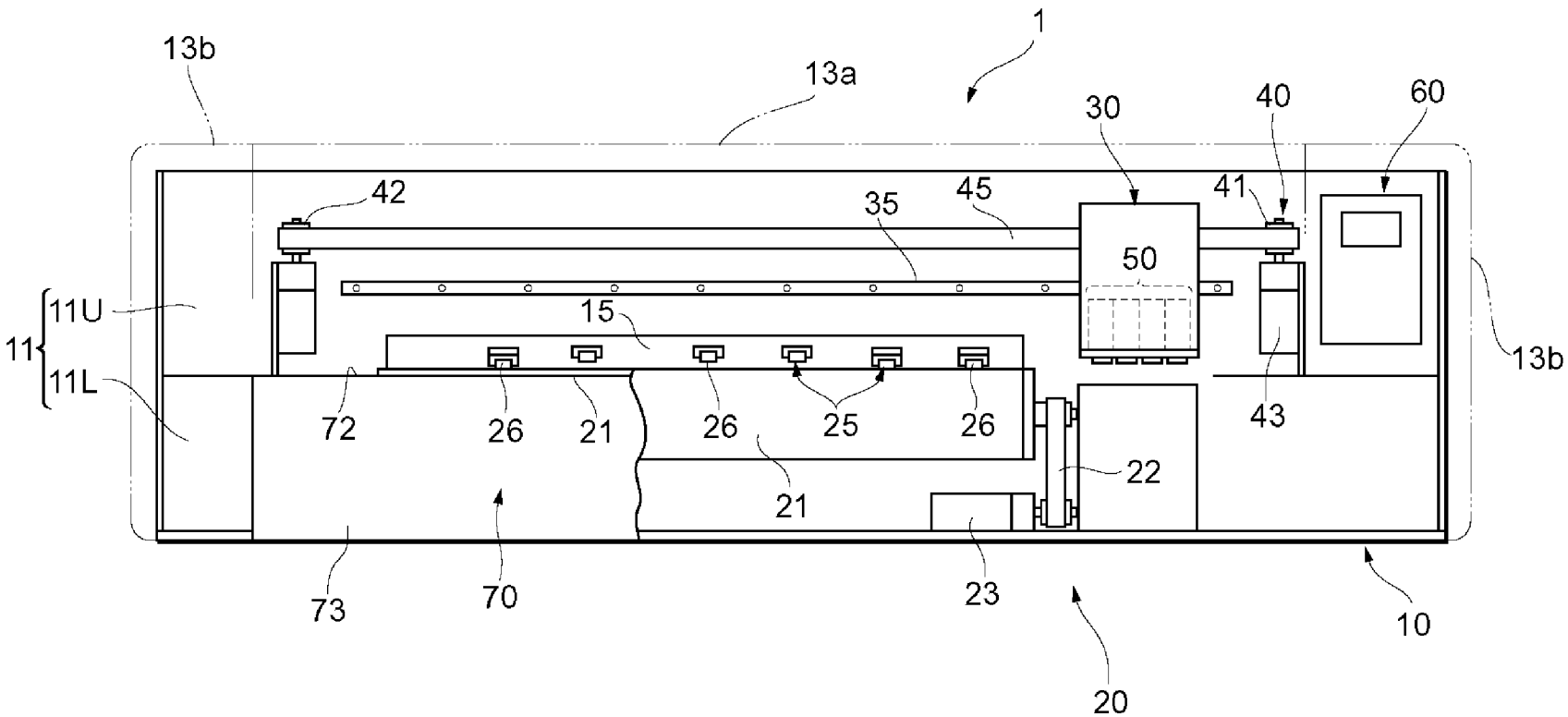
FIG. 3 is a front view showing a main structure of an apparatus main body in the printer apparatus.

The embodiments of the present invention will be described below with reference to the accompanying drawings, wherein like reference numerals designate corresponding or identical elements throughout the various drawings. As an example of an inkjet printer to which the present invention is applied, a type of printer apparatus "P" will be described below in which one axis of two-axes "X-Y" is for a movement of a printing medium and the other axis is for a movement of a printer head. FIG. 1 is a perspective view showing the printer apparatus "P" which is viewed from an obliquely front side and FIG. 2 is a perspective view showing the printer apparatus "P" which is viewed from an obliquely rear side. FIG. 3 is a front view showing a main structure of an apparatus main body 1 in the printer apparatus "P". First, an entire structure of the printer apparatus "P" will be described below with reference to the accompanying drawings. In the following description, directions of the arrows "F", "R" and "U" shown in FIG. 1 are respectively referred to as a front side, a right side, and an upper side.

The printer apparatus "P" is an apparatus in which, while a printer head 50 (see FIG. 3) formed with a large number of nozzles is relatively moved with respect to a sheet-shaped printing medium "M" (also referred to as a medium) such as a vinyl chloride sheet, tarpaulin or a polyester film, fine particles of ink are ejected from the nozzles to print information such as a character, a figure, a pattern and a photograph on a surface to be printed. The printer apparatus "P" is, as shown in FIG. 1, provided with an apparatus main body 1 which is formed in a laterally long rectangular box-like shape for performing a drawing function, and a support part 2 which supports the apparatus main body 1 at a height position where working is easily performed. A printing medium supply mechanism 3 for supplying a printing medium "M" in an unprinted state which is wound around in a roll shape to the apparatus main body 1 and a printing medium winding mechanism 4 for winding the printing medium "M" after having been printed is wound are provided on front and rear sides of right and left legs 2*a* which structure the support part 2.

The apparatus main body 1 is, as shown in FIGS. 1 and 3, structured of a body 10, which is a mounting base for respective mechanisms, a platen 70 for placing a printing medium "M", a medium moving mechanism 20 which is capable of moving the printing medium "M" placed on the platen 70 in a front and rear direction, a carriage 30 which is located above the platen 70 and is supported in a movable state in a right and left direction, a carriage moving mechanism 40 which relatively moves the carriage 30 in the right and left direction with respect to the printing medium "M" placed on the platen 70, a plurality of printer heads 50 which are held by the carriage 30 in a separated state with a predetermined distance from the printing medium "M", a control unit 60 which controls operations of respective parts of the printer apparatus "P" such as movement in the front and rear direction of the printing medium "M" by the medium moving mechanism 20, movement in the right and left direction of the carriage 30 by the carriage moving mechanism 40, ejections of inks from respective nozzles of the printer head 50, and the like.

The body 10 is, as shown in FIG. 3, provided with a main body frame 11 which is structured of a lower frame 11L having the platen 70 and the like and an upper frame 11U having the carriage 30 and the like. A medium passing part 15 formed in a laterally long window shape is formed between the upper frame 11U and the lower frame 11L so that a printing medium "M" is capable of passing through in the front and rear direction. The body 10 is surrounded by a front cover 13*a* which covers a center part of the main body frame 11 and side covers 13*b* which cover the right and left sides and the body 10 is structured in a laterally long rectangular box-like shape as a whole.

The medium moving mechanism 20 is structured of a feed roller 21 formed in a cylindrical tube shape, which is turnably provided around a rotation shaft extended in the right and left direction and disposed so that its upper peripheral face is exposed from a support face of the platen 70, a servomotor 23 which rotatably drives the feed roller 21, a timing belt 22 which is stretched over a driven pulley coupled to a shaft end of the feed roller 21 and a drive pulley coupled to a shaft end of the servomotor 23, a plurality of roller assemblies 25 which are provided with a pinch roller 26 that is turnable in the front and rear direction and are disposed on an upper side with respect to the feed roller 21 with a predetermined interval in the right and left direction, and the like. The roller assembly 25 is structured so that the pinch roller 26 is capable of being displaced between a clamp position where the pinch roller 26 is elastically engaged with the feed roller 21 and an unclamp position where the pinch roller 26 is separated to an upper side of the feed roller 21. When the feed roller 21 is turned in a state that the roller assemblies 25 are set in the clamp position and a printing medium "M" is sandwiched between the upper and lower rollers 26 and 21, the printing medium "M" is carried in the front and rear direction by a feeding amount corresponding to a turning angle of the feed roller 21.

The carriage moving mechanism 40 is structured of a drive pulley 41 and a driven pulley 42, which are provided in the vicinities of right and left side ends of a guide rail 35 that is attached to the upper frame 11U, a servomotor 43 for rotationally driving the drive pulley 41, a timing belt 45 formed in an endless belt shape which is stretched over the drive pulley 41 and the driven pulley 42, and the like. The carriage 30 is connected and fixed to the timing belt 45.

The control unit 60 is provided on the right side upper part of the body 10 and the control unit 60 is a control device for controlling operations of the respective parts of the printer apparatus "P" such as a movement in the front and rear direction of a printing medium "M" by the medium moving mechanism 20, a movement in the right and left direction of the carriage 30 by the carriage moving mechanism 40, and ejections of inks from respective nozzles of the printer head 50. The control unit 60 combines a movement in the front and rear direction of a printing medium "M" by the medium moving mechanism 20 with a movement in the right and left direction of the carriage 30 by the carriage moving mechanism 40 so that the printing medium "M" and the printer head 50 are relatively moved to each other, and inks are ejected from the respective nozzles of the printer head 50 onto the printing medium "M" to perform printing on the printing medium "M". An operation panel 65 is, as shown in FIG. 1, provided on a right side upper part of the body 10 and provided with a display for indicating various information and the like. An operator is capable of setting printing conditions to perform printing while confirming indicated contents on the display.

Figure 4:
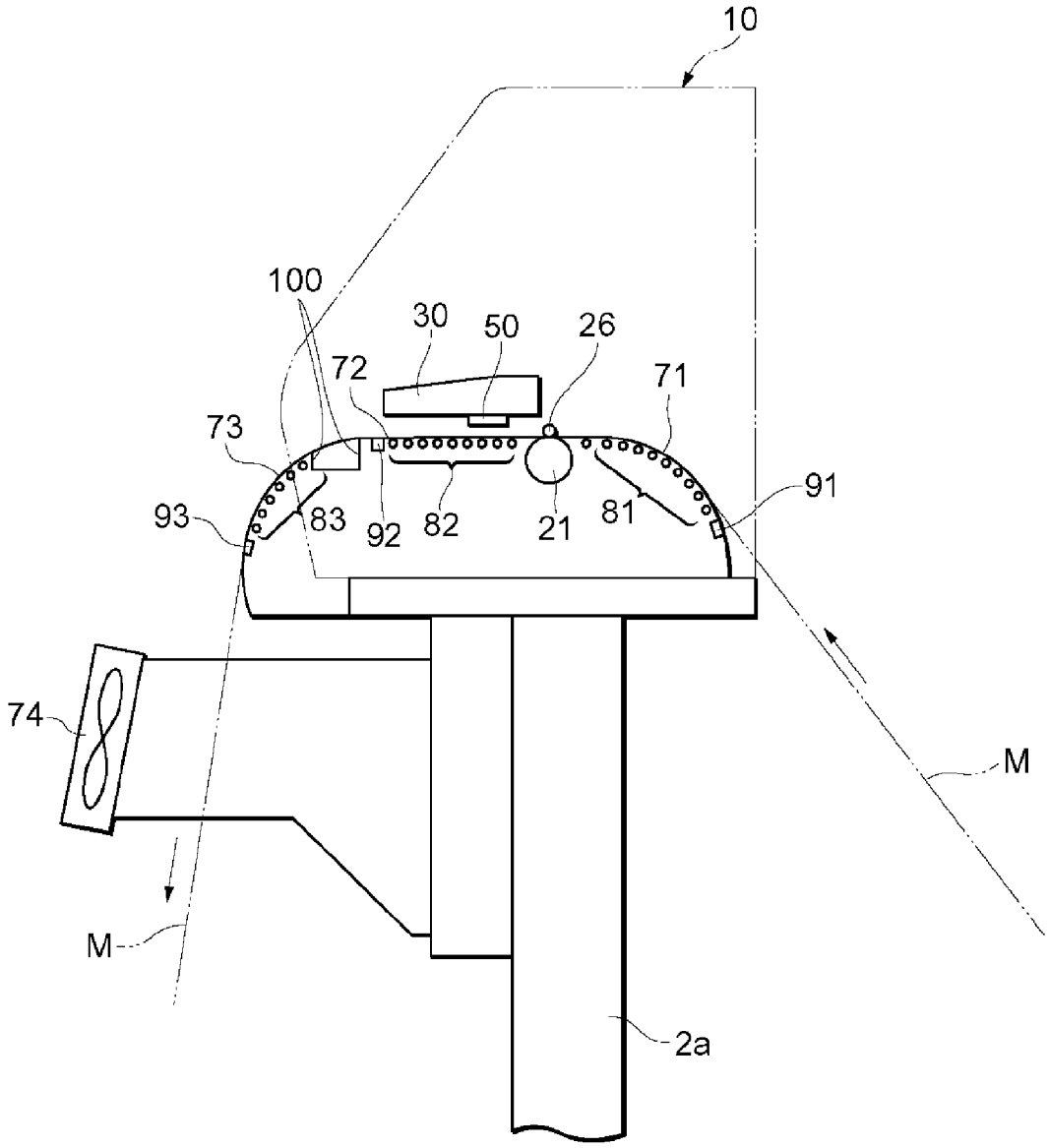
FIG. 4 is a schematic cross-sectional side view showing the printer apparatus which is viewed in the arrow "V" direction in FIG. 1.
Figure 5:
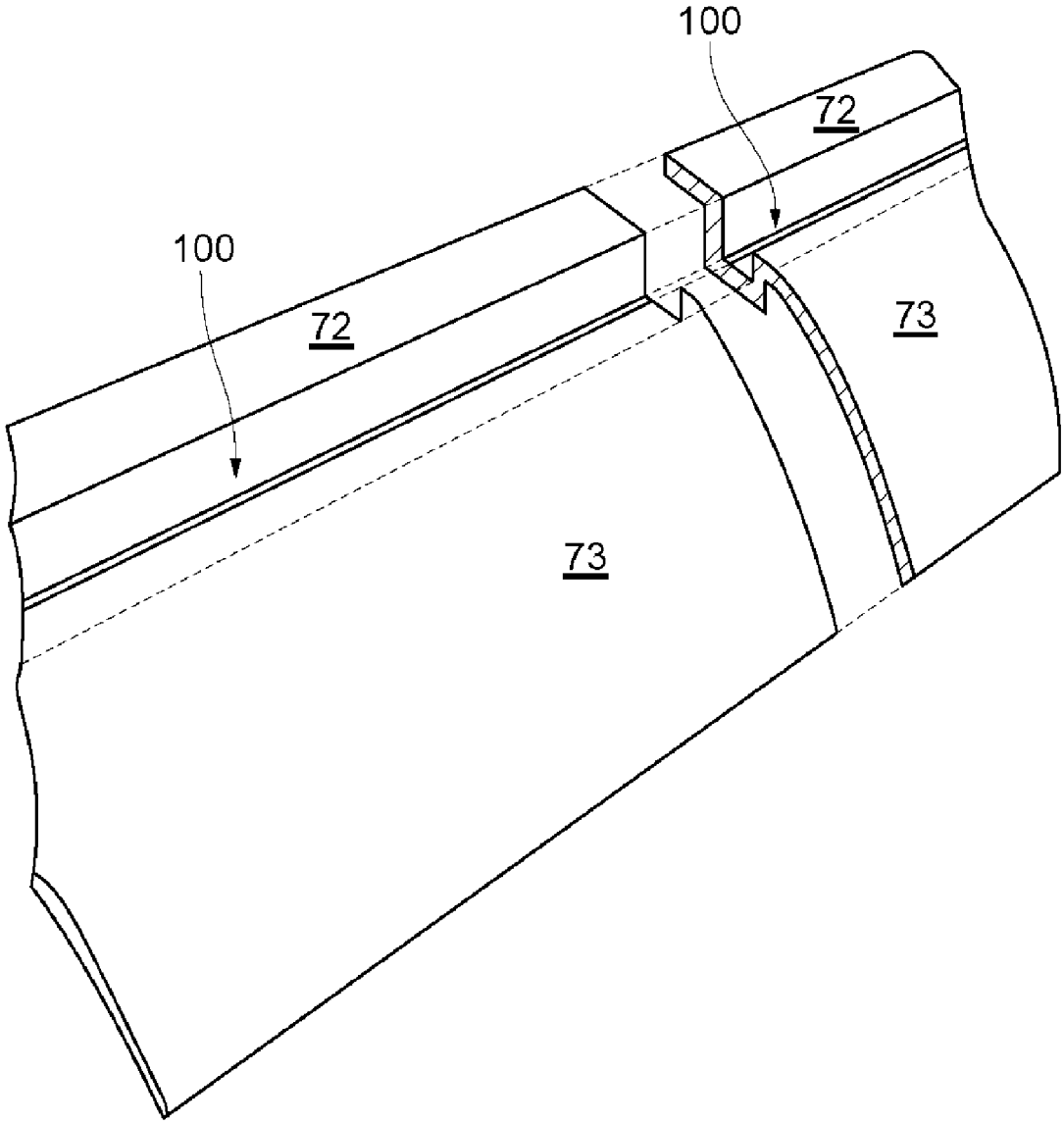
FIG. 5 is an outward appearance perspective view showing a groove part 100 provided between a main platen and a front platen in the printer apparatus which is viewed from an obliquely front side.

The platen 70 is located at a center part in the right and left direction of the body 10 and provided over the front and rear sides of the medium passing part 15. As shown in FIG. 4 which is a schematic cross-sectional view showing the printer apparatus "P" that is viewed in the direction shown by the arrow "V" in FIG. 1, the platen 70 is structured of a main platen 72 which is formed with a support face that horizontally supports a printing medium "M" on a printing part (drawing region) where the printer head 50 is moved in the right and left direction for printing, a rear platen 71 which is extended from the main platen 72 to a rear side and provided on a rear face side of the body 10, a front platen 73 which is extended from the main platen 72 to a front side and provided on a front face side of the body 10, and the like. A rear end side of the rear platen 71 and a front end side of the front platen 73 are extended downward so as to respectively draw a smooth curve and a printing medium "M" which is supplied to the platen 70 from the printing medium supply mechanism 3 is smoothly moved on the upper faces of the rear platen 71, the main platen 72 and the front platen 73 to be wound by the printing medium winding mechanism 4.

A plurality of fans 74 for blowing the outside air onto the printing medium "M" to facilitate drying of inks adhered on the printing medium "M" is provided side by side on a front lower part of the front platen 73. In this embodiment, suction holes (not shown) are provided in the support face of the main platen 72 which supports the printing medium "M", and a decompression chamber (not shown) is provided in the lower part of the suction holes so as to be capable of being set in a negative pressure. When a negative pressure is generated by the decompression chamber, the printing medium "M" can be sucked and held on the support face of the main platen 72 through the suction holes.

The platen 70 (71, 72, 73) is structured of material having a small coefficient of thermal conductivity and thus the platen 70 (71, 72, 73) is not easily affected by a temperature change. A temperature of an upper face of the platen 70 (71, 72, 73) is adjustable in order to improve an image quality and to dry inks having been ejected. Therefore, in order to adjust a temperature of the upper face of the platen 70 (71, 72, 73), as shown in FIG. 4, a back face of the platen 70 (71, 72, 73) is provided with a pre-heater 81 for warming a printing medium "M" in an unprinted state, a print heater 82 for improving an adhesion property of fine particles of inks ejected from the printer head 50 to improve an image quality, and an after-heater 83 for facilitating drying of the adhered inks. An on/off operation for the pre-heater 81, the print heater 82 and the after-heater 83 is capable of being performed through a heater switch (not shown) which is provided at a right side upper part of the body 10. Respective preset temperatures of the pre-heater 81, the print heater 82 and the after-heater 83 are adjustable through an operation panel 65, and the respective heaters 81, 82 and 83 are independently provided so as not to be affected by other heaters. Further, temperatures of the rear platen 71, the main platen 72 and the front platen 73 are respectively capable of being detected by temperature detection sensors 91, 92 and 93 (see FIG. 4) which are provided in the respective platens 71, 72 and 73.

Further, a groove part 100 whose length in the front and rear direction (moving direction of a printing medium) is 10 cm and whose depth is 10 cm is provided at a side edge part of the after-heater 83 which is provided on the front side of the main platen 72 (between the main platen 72 and the front platen 73) so as to extend in the right and left direction (direction perpendicular to the moving direction of a printing medium). A printing medium "M" onto which inks are ejected from the under face of the printer head 50 is moved to an upper face of the groove part 100, and heat by the print heater 82 for raising a temperature of the placing face of the main platen 72 and heat by the after-heater 83 for raising a temperature of the placing face of the front platen 73 are not reached to the printing medium "M" located on the upper face of the groove part 100.

A method for performing printing on a printing medium "M" by using the printer apparatus "P" which is structured as described above will be described below. First, after a printing medium "M" which is in an unprinted roll state is set in the printing medium supply mechanism 3, a tip end of the printing medium "M" in a roll state is raised to the upper faces of the rear platen 71 and the main platen 72. Further, a winding tube (not shown) for winding up the printing medium having been printed is set in the printing medium winding mechanism 4 and the tip end of the printing medium "M" is stuck to the winding tube which has been set. When printing is started in this state, printing to the printing medium "M" located on the upper part of the main platen 72 is started and the printing medium "M" in which printing has finished is fed out to the front side of the platen 70 by the medium moving mechanism 20 and then, the printed face of the printing medium "M" which has been fed out is dried by the after-heater 83 and the fan 74. In this case, a rotation start torque for rotating the winding tube in a winding direction of the printing medium "M" is applied by a tensile force applying means (not shown) which is incorporated into the printing medium winding mechanism 4 and then, the printing medium "M" begins to be wound up around the winding tube in a state that the printed face is contacted with the outer face of the winding tube. As described above, at every time when the printing medium "M" on which printing has finished is fed out, a torque is applied by the tensile force applying means (not shown) and the printing medium "M" on which printing has finished is gradually wound up around the winding tube.

In a case that printing is performed as described above, a cockling phenomenon is occurred where fine cockles are formed in the printing medium on which inks have been ejected and a paper surface is waved and, when a portion where the cockling phenomenon is occurred is warmed, the cockles become larger. The occurrence itself of the phenomenon is not a problem because, even when the cockles become larger, they may be invisible by naked eyes. However, when the cockles having been warmed and become larger are occurred at a position of an under face of the printer head 50 and inks are ejected to this portion, its printing quality may be lowered. Therefore, in order to prevent occurrence of the cockles having been warmed and become larger at the position of the under face of the printer head, a temperature of the placing face of the main platen 72 which faces the under face of the printer head 50 is required to be made low.

Further, a temperature of the placing face of the front platen 73 which is located on the front side of the main platen 72 is required to maintain in a some high temperature state in order to completely dry the printing medium after printing has finished. On the other hand, similarly to the phenomenon described above, when the placing face of the front platen 73 is warmed by the after-heater 83, cockles occurred in the printing medium "M" due to cockling phenomenon become larger. Therefore, like a conventional printer apparatus, in a case that the front platen 73 is located just ahead of the main platen 72, a portion where cockles have become larger due to waving of the cockles may be extended to an ink ejected portion which faces the under face of the printer head. As described above, the portion where the cockles have become larger is extended to a portion where inks are to be ejected and, when the inks are ejected to the portion, the printed quality is lowered.

In order to cope with the problem described above, in the printer apparatus "P" in this embodiment, the groove part 100 described above is provided and thus the printing medium "M" just after inks have been ejected is not placed on the front platen 73 and is not warmed by the after-heater 83. Specifically, after an operator adjusts temperatures of the placing faces of the main platen 72 and the front platen 73 through the operation panel 65, printing is started. A printing medium "M" is placed on the placing face of the main platen 72 and, after inks have been ejected by the printer head 50, fine cockles are occurred but the printing medium "M" in which cockles have been occurred is moved to the upper face of the groove part 100 instead of moving to the placing face of the front platen 73 immediately. After the printing medium "M" has been moved about 10 cm on the upper side of the groove part 100, the printing medium "M" is reached to the placing face of the front platen 73.

As described above, when the groove part 100 is provided between the main platen 72 and the front platen 73 and the main platen 72 and the front platen 73 are separated by a distance of the groove part 100 (about 10 cm), large cockles which have been occurred by being warmed by the after-heater 83 do not extend to the portion where the inks are to be ejected which faces the under face of the printer head 50 and thus degradation of printing quality can be prevented surely.

In this embodiment, the groove part 100 is provided on the front side of the main platen 72 and thus a portion of a printing medium "M" where inks have been ejected is not moved to the placing face of the front platen 73 immediately and is not warmed by the after-heater 83 for drying the printing medium "M". Therefore, a problem can be prevented surely in which cockles becoming larger are occurred at a drawing portion just under the printer head 50 to degrade the printing quality.

In this embodiment, the groove part 100 whose length in the front and rear direction is 10 cm and whose depth is 10 cm is provided in the printer apparatus "P" but the length or the depth of the groove part is not limited to this embodiment.

Further, in the present embodiment, the groove part 100 is used in order that a printing medium "M" just after inks have been ejected is not warmed by the after-heater 83. However, a structure for preventing a printing medium "M" from being warmed by the after-heater 83 is not limited to the embodiment described above. Modified embodiments of a structure which does not raise a temperature of a printing medium "M" just after inks have been ejected will be described below as examples 1 through 5.

Example 1

Figure 6A:
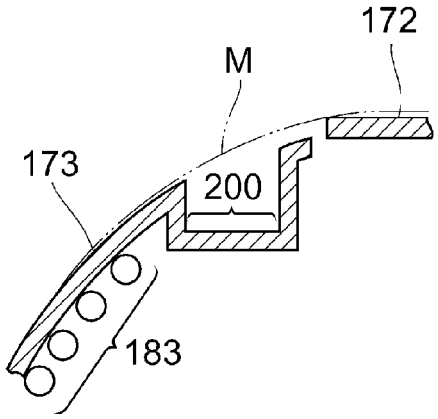
FIGS. 6A, 6B, 6C, and 6D are views showing main platens and front platens in accordance with modified embodiments.

In an example 1, as shown in FIG. 6A, a main platen 172, a front platen 173, an after-heater 183 and a groove part 200 are provided which are similar structural elements to the main platen 72, the front platen 73, the after-heater 83 and the groove part 100. However, this example 1 is different from the above-mentioned embodiment in that a stepped part is formed between the main platen 172 and the front platen 173 and, in addition, the main platen 172 and the front platen 173 are physically separated from each other. When the main platen 172 and the front platen 173 are physically separated from each other as described above, heat of the after-heater 183 is surely prevented from affecting the main platen 172 and heat supply to the printing medium "M" just after inks have been ejected can be shut off further effectively.

Example 2

Figure 6B:
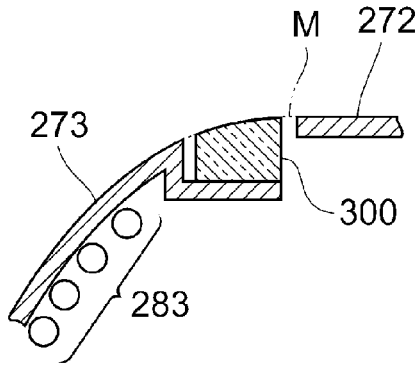

In an example 2, as shown in FIG. 6B, a main platen 272, a front platen 273 and an after-heater 283 are provided which are similar structural elements to the main platen 72, the front platen 73 and the after-heater 83. Further, like the example 1, a stepped part is formed between the main platen 272 and the front platen 273 to be physically separated from each other and, in addition, a heat insulation member 300 structured of material whose coefficient of thermal conductivity is low is provided between the main platen 272 and the front platen 273. Heat of the after-heater 283 can be prevented from affecting the main platen 172 by the heat insulation member 300 and thus the heat can be effectively shut off to the printing medium "M" just after inks have been ejected.

Example 3

Figure 6C:
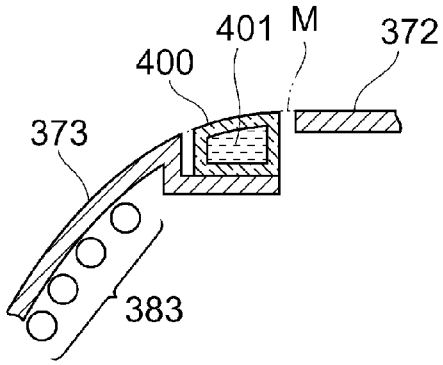

In an example 3, as shown in FIG. 6C, a main platen 372, a front platen 373 and an after-heater 383 are provided which are similar structural elements to the main platen 72, the front platen 73 and the after-heater 83. Further, like the example 1, a stepped part is formed between the main platen 372 and the front platen 373 to be physically separated from each other and, in addition, a cooling pipe 400 is provided between the main platen 372 and the front platen 373. Cooling water 401 can be circulated in an inside of the cooling pipe 400 and heat generated by the after-heater 383 is surely cooled down by the cooling pipe 400 and the heat of the after-heater 383 does not affect the main platen 372. As described above, in the example 3, different from the examples 1 and 2, since cooling of the printing medium "M" is positively performed, heat can be further effectively shut off to the printing medium "M" just after inks have been ejected.

Example 4

Figure 6D:
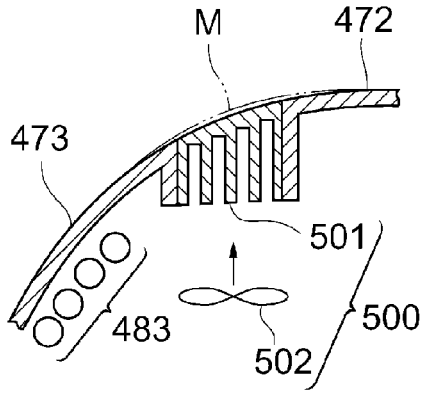

In an example 4, as shown in FIG. 6D, a main platen 472, a front platen 473 and an after-heater 483 are provided which are similar structural elements to the main platen 72, the front platen 73 and the after-heater 83. Further, a heat radiation means 500 for radiating heat of the after-heater 483 is provided between the main platen 472 and the front platen 473. The heat radiation means 500 is structured of a heat radiation member 501 made of material having a high heat radiation property such as aluminum and a cooling fan 502 which is provided on an underside of the heat radiation member 501. The heat radiation member 501 is formed in a shape so that a number of projected and recessed parts are formed on its under face. When a surface area is increased as described above, heat radiation property can be further enhanced and thus heat generated by the after-heater 483 is radiated by the heat radiation means 500 and the heat is not transmitted to the main platen 472.

Example 5

Figure 7:
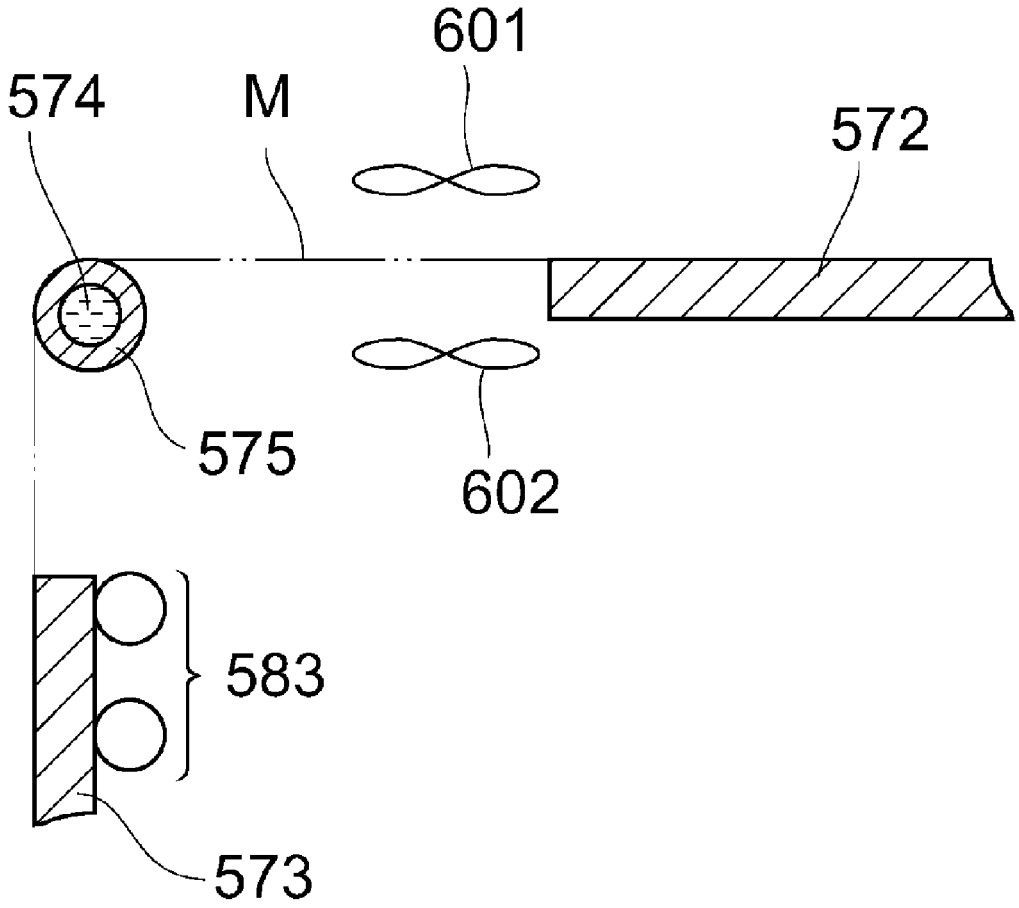
FIG. 7 is a view showing a state in which a main platen and a front platen are physically separated from each other and a roller and cooling fans are disposed between the main platen and the front platen.

In an example 5, as shown in FIG. 7, a main platen 572, a front platen 573 and an after-heater 583 are provided which correspond to the main platen 72, the front platen 73 and the after-heater 83. The example 5 is different from the examples 1 through 4 in the point that the front platen 573 is extended downward. In addition, a roller 575 is provided between the main platen 572 and the front platen 573 and a feeding direction of a printing medium "M" which is fed out from the main platen 572 is changed by the roller 575 and guided to the front platen 573.

Further, in the example 5, a first cooling fan 601 is provided on an upper side with respect to a printing medium "M" which is fed out from the main platen 572 and a second cooling fan 602 is provided on a lower side with respect to the printing medium "M". Heat of the after-heater 583 is not reached to a portion just after inks have been ejected of a printing medium "M" by the cooling fans 601 and 602. In addition, similarly to the cooling pipe 400 in the example 3, an inside of the roller 575 is structured so that cooling water 574 can be circulated. Therefore, when a printing medium "M" is abutted with the surface of the roller 575 which has been cooled by the cooling water 574, heat of the after-heater 583 is further effectively absorbed and supply of heat to the main platen 572 can be prevented.

In the embodiments including the above-mentioned examples 1 through 5, a type of inkjet printer is described in which one axis is for a movement of a printing medium and one axis is for a movement of a printer head. However, the present invention is not limited to this type of inkjet printer. For example, the groove parts 100 and 200, the heat insulation member 300, the cooling pipe 400, the heat radiation means 500, the cooling fans 601 and 602, or the roller 575 may be provided in other types of inkjet printer such as an inkjet printer in two-axes printer head moving type or an inkjet printer in two-axes printing medium moving type. In these cases, similar effects to the above mentioned embodiments can be obtained.

The embodiment of the present invention provides an inkjet printer including a platen having a placing face on which a printing medium in an elongated sheet shape is held, a printing means (for example, the carriage 30 and the carriage moving mechanism 40 in the embodiment) which is provided with a printer head that is oppositely disposed to the placing face of the platen and that ejects ink to a printing target region of the printing medium to perform printing and in which ink is ejected while the printer head is relatively moved to the printing medium that is placed on the placing face of the platen to perform printing on the printing medium, a printing medium feeding means (for example, the medium moving mechanism 20 in the embodiment) which feeds the printing medium that is placed on the placing face of the platen out from the platen depending on the printing by the printing means, a guide part (for example, the front platen 73 in the embodiment) which is provided on a feeding-out side where the printing medium is to be fed out with respect to the platen and which is provided with a guide face on which the printing medium having been fed out from the placing face of the platen is placed and held, a printing medium temperature raising means (for example, the after-heater 83 in the embodiment) which heats the guide face for raising a temperature of the printing medium placed on the guide face, and a temperature raising preventing part which is provided between the placing face at a position facing the printing target region and the guide face of the guide part and prevents a portion of the printing medium, which is extended to the feeding-out side by a predetermined length from the printing target region where the ink is ejected from the printer head, from being heated by the printing medium temperature raising means.

Further, in the inkjet printer in accordance with the embodiment of the present invention, it is preferable that the temperature raising preventing part is a recessed part (for example, the groove part 100 in the embodiment) which is provided with an opened face on the same plane as the placing face of the platen, and the recessed part is formed to be extended in a direction perpendicular to a direction that the printing medium is fed out. In addition, it is preferable that heat conduction from the guide part to the platen is shut off.

In the inkjet printer in accordance with the embodiment of the present invention, a portion of the printing medium which is extended to the feeding-out side by a predetermined length from the printing target region where the ink is ejected from the printer head is prevented by the temperature raising preventing part from being heated. Therefore, cockles occurred in the printing medium due to temperature raising of the printing medium are prevented from reaching to the under face of the printer head and degradation of the printing quality can be surely prevented. Further, when heat conduction from the guide part to the platen is shut off, heat is not transmitted to the vicinity of the head and thus cockles can be surely prevented from reaching to the printing medium that is located in the vicinity of the under face of the head.

Obviously, numerous modifications and variations of the present invention are possible in light of the above teachings. It is therefore to be understood that within the scope of the appended claims, the invention may be practiced otherwise than as specifically described herein.

The invention claimed is:

1. An inkjet printer comprising:

a printing device including a printer head to eject ink to a printing medium, the printer head being configured to eject ink while the printer head relatively moves with respect to the printing medium;

a printing medium feeding device configured to feed the printing medium;

a platen on which the printing medium is to be placed and having a main platen and a front platen, the main platen facing the printer head, the front platen being provided on a feeding-out side via which the printing medium is to be fed out from the main platen to hold the printing medium which have been fed out from the main platen;

a printing medium temperature raising device provided to the front platen to heat the front platen so as to raise a temperature of the printing medium placed on the front platen; and a temperature raising preventing device provided between the front platen and the main platen, the temperature raising preventing device being configured to prevent a portion of the printing medium on the main platen from being heated by the printing medium temperature raising device.

2. The inkjet printer according to claim 1, wherein the temperature raising preventing device comprises a recessed part recessed from a same plane as a surface of the main platen, the recessed part extending in a direction substantially perpendicular to a direction where the printing medium is fed out.

3. The inkjet printer according to claim 1, wherein the temperature raising preventing device prevents at least a part of heat conduction from the front platen to the main platen.

4. The inkjet printer according to claim 2, wherein the temperature raising preventing device prevents at least a part of heat conduction from the front platen to the main platen.

5. The inkjet printer according to claim 1, wherein the temperature raising preventing device comprises a heat insulation member.

6. The inkjet printer according to claim 1, wherein the temperature raising preventing device is provided next to the main platen in a direction where the printing medium is fed out.

7. The inkjet printer according to claim 6, wherein the temperature raising preventing device comprises:

a recessed part recessed from a same plane as a surface of the main platen, the recessed part extending in a direction substantially perpendicular to a direction where the printing medium is fed out; and a cooling pipe provided to the recessed part, and cooling water is flowed in an inside of the cooling pipe.

8. The inkjet printer according to claim 6, wherein the temperature raising preventing device comprises a heat radiation device including a high heat radiation member and a cooling fan which provides cooling air to the high heat radiation member.

9. The inkjet printer according to claim 6, wherein the temperature raising preventing device comprises a first cooling fan provided at an upper side of the printing medium and a second cooling fan provided at a lower side of the printing medium.

10. The inkjet printer according to claim 6, wherein the temperature raising preventing device comprises a cooling roller which guides the printing medium from the main platen to the front platen, and cooling water flows in an inside of the cooling roller.

11. An inkjet printer comprising:

printing means for printing on a printing medium, the printing means including a printer head to eject ink to the printing medium, the printer head being configured to eject ink while the printer head relatively moves with respect to the printing medium;

printing medium feeding means for feeding the printing medium;

a platen on which the printing medium is to be placed and having a main platen and a front platen, the main platen facing the printer head, the front platen being provided on a feeding-out side via which the printing medium is to be fed out from the main platen to hold the printing medium which have been fed out from the main platen;

printing medium temperature raising means provided to the front platen for heating the front platen so as to raise a temperature of the printing medium placed on the front platen; and temperature raising preventing means for preventing a portion of the printing medium on the main platen from being heated by the printing medium temperature raising means, the temperature raising preventing means being provided between the front platen and the main platen.

12. The inkjet printer according to claim 11, wherein the temperature raising preventing means comprises a recessed part recessed from a same plane as a surface of the main platen, the recessed part extending in a direction substantially perpendicular to a direction where the printing medium is fed out.

13. The inkjet printer according to claim 11, wherein the temperature raising preventing means comprises heat insulation means for insulating heat between the front platen and the main platen.

14. The inkjet printer according to claim 11, wherein the temperature raising preventing means is provided next to the main platen in a direction where the printing medium is fed out.

15. The inkjet printer according to claim 14, wherein the temperature raising preventing means comprises:

a recessed part recessed from a same plane as a surface of the main platen, the recessed part extending in a direction substantially perpendicular to a direction where the printing medium is fed out; and a cooling pipe provided to the recessed part, and cooling water is flowed in an inside of the cooling pipe.

16. The inkjet printer according to claim 14, wherein the temperature raising preventing means comprises a cooling pipe, and cooling water is flowed in an inside of the cooling pipe.

17. The inkjet printer according to claim 14, wherein the temperature raising preventing means comprises heat radiation means for radiating heat which includes a high heat radiation member and a cooling fan which provides cooling air to the high heat radiation member.

18. The inkjet printer according to claim 14, wherein the temperature raising preventing means comprises a first cooling fan provided at an upper side of the printing medium and a second cooling fan provided at a lower side of the printing medium.

19. The inkjet printer according to claim 14, wherein the temperature raising preventing means comprises a cooling roller which guides the printing medium from the main platen to the front platen, and cooling water flows in an inside of the cooling roller.

* * * * *